US009861160B2

(12) United States Patent
Podhajny et al.

(10) Patent No.: US 9,861,160 B2
(45) **Date of Patent: *Jan. 9, 2018**

(54) ARTICLE OF FOOTWEAR INCORPORATING A KNITTED COMPONENT

(71) Applicant: NIKE, Inc., Beaverton, OR (US)

(72) Inventors: Daniel A. Podhajny, Beaverton, OR (US); Benjamin A. Shaffer, Portland, OR (US); Erin E. Toraya, Portland, OR (US); Robert C. Williams, Jr., Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 777 days.

This patent is subject to a terminal disclaimer.

(21) Appl. No.: 13/691,316

(22) Filed: Nov. 30, 2012

(65) Prior Publication Data

US 2014/0150292 A1 Jun. 5, 2014

(51) Int. Cl.
*A43B 1/04* (2006.01)
*A43B 23/02* (2006.01)
(Continued)

(52) U.S. Cl.
CPC ..... *A43B 23/0205* (2013.01); *A43B 1/04* (2013.01); *A43B 23/0245* (2013.01); *A43B 23/0265* (2013.01); *A43B 23/042* (2013.01); *A43C 5/00* (2013.01); *D04B 1/102* (2013.01); *D04B 1/106* (2013.01); *D04B 1/123* (2013.01); *D04B 1/18* (2013.01); *D10B 2403/032* (2013.01); *D10B 2501/043* (2013.01)

(58) Field of Classification Search
CPC ..... A43B 1/04; A43B 23/02; A43B 23/0245; A43B 23/042; A43C 5/00
USPC ..... 36/45, 47, 48, 49, 50.1
See application file for complete search history.

(56) References Cited

U.S. PATENT DOCUMENTS 601,192 A 3/1898 Woodside
1,215,198 A 2/1917 Rothstein
(Continued)

FOREIGN PATENT DOCUMENTS

CN 101125044 A 2/2008
CN 102271548 A 12/2011
(Continued)

OTHER PUBLICATIONS

Official Letter and Search Report dated Mar. 3, 2015 for Taiwan Application No. 102142345.
(Continued)

*Primary Examiner* — Sharon M Prange
(74) *Attorney, Agent, or Firm* — Brinks Gilson & Lione

(57) ABSTRACT

An article of footwear may have an upper with a knitted component. Alone or in combination, the knitted component may include regions with different degrees of stretch-resistance; the knitted component forms a collar with a half-gauge knit; the upper includes a strand with sections that are inlaid within the knitted component, and the sections are positioned immediately adjacent to each other; the strand forms a plurality of loops, pairs of the loops are positioned immediately adjacent to each other and configured to receive a lace; and the knitted component includes a thermoplastic polymer material, and the strand is unbonded to the thermoplastic polymer material.

16 Claims, 19 Drawing Sheets

(51) Int. Cl.

| | |
|---|---|
| ***A43B 23/04*** | (2006.01) |
| ***A43C 5/00*** | (2006.01) |
| ***D04B 1/10*** | (2006.01) |
| ***D04B 1/18*** | (2006.01) |
| ***D04B 1/12*** | (2006.01) |

(56) References Cited

U.S. PATENT DOCUMENTS

| | | | | |
|---|---|---|---|---|
| 1,597,934 | A | 8/1926 | Stimpson | |
| 1,888,172 | A | 11/1932 | Joha | |
| 1,902,780 | A | 3/1933 | Holden et al. | |
| 1,910,251 | A | 5/1933 | Joha | |
| 2,001,293 | A | 5/1935 | Wilson | |
| 2,034,091 | A | 3/1936 | Dunbar | |
| 2,047,724 | A | 7/1936 | Zuckerman | |
| 2,048,294 | A | 7/1936 | Roberts | |
| 2,147,197 | A | 2/1939 | Glidden | |
| 2,205,356 | A | 6/1940 | Gruensfelder | |
| 2,311,996 | A | 2/1943 | Parker | |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,569,764 | A | 10/1951 | Jonas | |
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,994,322 | A | 8/1961 | Cullen et al. | |
| 3,439,434 | A | 4/1969 | Tangorra | |
| 3,583,081 | A | 6/1971 | Hayashi | |
| 3,672,078 | A | 6/1972 | Fukuoka | |
| 3,694,940 | A | 10/1972 | Stohr | |
| 3,704,474 | A | 12/1972 | Winkler | |
| 3,766,566 | A | 10/1973 | Tadakoro | |
| 3,778,856 | A | 12/1973 | Christie et al. | |
| 3,823,493 | A | 7/1974 | Brehm et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Mortara | |
| 4,465,448 | A | 8/1984 | Aldridge | |
| 4,607,439 | A | 8/1986 | Harada | |
| 4,627,369 | A | 12/1986 | Conrad et al. | |
| 4,634,616 | A | 1/1987 | Musante | |
| 4,642,819 | A | 2/1987 | Ales et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 4,858,339 | A | 8/1989 | Hayafuchi et al. | |
| 4,873,725 | A | 10/1989 | Mitchell | |
| 5,031,423 | A | 7/1991 | Ikenaga | |
| 5,095,720 | A | 3/1992 | Tibbals, Jr. | |
| 5,117,567 | A | 6/1992 | Berger | |
| 5,149,388 | A | 9/1992 | Stahl | |
| 5,152,025 | A | 10/1992 | Hirmas | |
| 5,156,022 | A | 10/1992 | Altman | |
| 5,192,601 | A | 3/1993 | Neisler | |
| 5,271,130 | A | 12/1993 | Batra | |
| 5,285,658 | A | 2/1994 | Altman et al. | |
| 5,345,638 | A | 9/1994 | Nishida | |
| 5,353,524 | A | 10/1994 | Brier | |
| 5,359,790 | A | 11/1994 | Iverson et al. | |
| 5,367,795 | A | 11/1994 | Iverson et al. | |
| 5,371,957 | A | 12/1994 | Gaudio | |
| 5,380,480 | A | 1/1995 | Okine et al. | |
| 5,399,410 | A | 3/1995 | Urase | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,645,935 | A | 7/1997 | Kemper et al. | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,832,540 | A | 11/1998 | Knight | |
| D405,587 | S | 2/1999 | Merikoski | |
| 5,884,419 | A | 3/1999 | Davidowitz et al. | |
| 5,930,918 | A | 8/1999 | Healy | |
| 5,990,378 | A | 11/1999 | Ellis | |
| 5,996,189 | A | 12/1999 | Wang | |
| 6,003,247 | A | 12/1999 | Steffe | |
| 6,004,891 | A | 12/1999 | Tuppin et al. | |
| 6,009,637 | A | 1/2000 | Pavone | |
| 6,029,376 | A | 2/2000 | Cass | |
| 6,032,387 | A | 3/2000 | Johnson | |
| 6,038,702 | A | 3/2000 | Knerr | |
| 6,052,921 | A | 4/2000 | Oreck | |
| 6,088,936 | A | 7/2000 | Bahl | |
| 6,128,835 | A | 10/2000 | Ritter | |
| 6,151,802 | A | 11/2000 | Reynolds | |
| 6,151,804 | A | 11/2000 | Hieblinger | |
| 6,164,228 | A | 12/2000 | Lin | |
| 6,170,175 | B1 | 1/2001 | Funk | |
| 6,213,634 | B1 | 4/2001 | Harrington et al. | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,615,427 | B1 | 9/2003 | Hailey | |
| 6,665,958 | B2 | 12/2003 | Goodwin | |
| 6,701,644 | B2 * | 3/2004 | Oorei | A43B 5/00 36/129 |
| 6,718,895 | B1 | 4/2004 | Fortuna | |
| 6,754,983 | B2 | 6/2004 | Hatfield et al. | |
| 6,860,214 | B1 | 2/2005 | Wang | |
| 6,910,288 | B2 | 6/2005 | Dua | |
| 6,922,917 | B2 | 8/2005 | Kerns et al. | |
| 6,931,762 | B1 | 8/2005 | Dua | |
| 6,990,755 | B2 | 1/2006 | Hatfield et al. | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,086,179 | B2 | 8/2006 | Dojan et al. | |
| 7,086,180 | B2 | 8/2006 | Dojan et al. | |
| 7,100,310 | B2 | 9/2006 | Foxen et al. | |
| 7,131,296 | B2 * | 11/2006 | Dua | A43B 1/04 66/178 R |
| 7,293,371 | B2 | 11/2007 | Aveni | |
| 7,347,011 | B2 | 2/2008 | Dua et al. | |
| 7,337,560 | B2 | 3/2008 | Marvin et al. | |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,574,818 | B2 | 8/2009 | Meschter | |
| 7,665,230 | B2 | 2/2010 | Dojan et al. | |
| 7,676,956 | B2 | 3/2010 | Dojan et al. | |
| 7,682,219 | B2 | 3/2010 | Falla | |
| 7,849,518 | B2 | 12/2010 | Moore et al. | |
| 7,870,681 | B2 | 1/2011 | Meschter | |
| 7,870,682 | B2 | 1/2011 | Meschter et al. | |
| 8,065,818 | B2 * | 11/2011 | Greene | A43B 9/00 12/142 E |
| 8,132,340 | B2 | 3/2012 | Meschter | |
| 8,453,357 | B2 * | 6/2013 | Beers | A43B 3/001 36/137 |
| 8,490,299 | B2 | 7/2013 | Dua et al. | |
| 8,875,418 | B2 * | 11/2014 | Long | A43B 23/0235 36/45 |
| 2001/0051484 | A1 | 12/2001 | Ishida et al. | |
| 2002/0078599 | A1 | 6/2002 | Delgorgue et al. | |

(56) References Cited

U.S. PATENT DOCUMENTS

| | | | | |
|---|---|---|---|---|
| 2002/0148258 | A1 | 10/2002 | Cole et al. | |
| 2003/0126762 | A1 | 7/2003 | Tseng | |
| 2003/0178738 | A1 | 9/2003 | Staub et al. | |
| 2003/0191427 | A1 | 10/2003 | Jay et al. | |
| 2004/0074589 | A1 | 4/2004 | Gessler et al. | |
| 2004/0118018 | A1 | 6/2004 | Dua | |
| 2004/0142631 | A1 | 7/2004 | Luk | |
| 2004/0181972 | A1 | 9/2004 | Csorba | |
| 2004/0261295 | A1 | 12/2004 | Meschter | |
| 2005/0028403 | A1 | 2/2005 | Swigart et al. | |
| 2005/0081402 | A1 | 4/2005 | Orei et al. | |
| 2005/0115284 | A1 | 6/2005 | Dua | |
| 2005/0132609 | A1 | 6/2005 | Dojan et al. | |
| 2005/0193592 | A1 | 9/2005 | Dua et al. | |
| 2005/0229641 | A1 | 10/2005 | Okamoto | |
| 2005/0268497 | A1 | 12/2005 | Alfaro et al. | |
| 2005/0273988 | A1 | 12/2005 | Christy | |
| 2005/0284000 | A1 | 12/2005 | Kerns | |
| 2006/0048413 | A1 | 3/2006 | Sokolwski et al. | |
| 2006/0059715 | A1 | 3/2006 | Aveni | |
| 2006/0130359 | A1 | 6/2006 | Dua et al. | |
| 2006/0137221 | A1 | 6/2006 | Dojan et al. | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0199210 | A1 | 8/2007 | Vattes et al. | |
| 2007/0271821 | A1 | 11/2007 | Meschter | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1* | 5/2008 | Sokolowski | A43B 3/0031 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0018075 | A1 | 1/2010 | Meschter et al. | |
| 2010/0037483 | A1 | 2/2010 | Meschter et al. | |
| 2010/0043253 | A1 | 2/2010 | Dojan et al. | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0175276 | A1 | 7/2010 | Dojan et al. | |
| 2010/0251491 | A1 | 10/2010 | Dojan et al. | |
| 2010/0269372 | A1 | 10/2010 | Dua et al. | |
| 2010/0281631 | A1 | 11/2010 | Dua et al. | |
| 2011/0030244 | A1 | 2/2011 | Motawi et al. | |
| 2011/0041359 | A1 | 2/2011 | Dojan et al. | |
| 2011/0078921 | A1 | 4/2011 | Greene et al. | |
| 2011/0225843 | A1 | 9/2011 | Kerns et al. | |
| 2012/0055044 | A1* | 3/2012 | Dojan | A43B 1/0027 36/87 |
| 2012/0084903 | A1* | 4/2012 | Roberts | A41B 9/02 2/400 |
| 2012/0198727 | A1 | 8/2012 | Long | |
| 2012/0233882 | A1 | 9/2012 | Huffa et al. | |
| 2012/0246973 | A1 | 10/2012 | Dua et al. | |
| 2012/0255201 | A1 | 10/2012 | Little | |
| 2012/0297642 | A1 | 11/2012 | Schaefer | |
| 2013/0019500 | A1* | 1/2013 | Greene | A43B 23/025 36/50.1 |
| 2013/0145652 | A1 | 6/2013 | Podhajny et al. | |

FOREIGN PATENT DOCUMENTS

| | | | |
|---|---|---|---|
| DE | 870963 | C | 3/1953 |
| DE | 1084173 | | 6/1960 |
| DE | 19738433 | | 4/1998 |
| DE | 19728848 | | 1/1999 |
| DE | 20215559 | | 1/2003 |
| EP | 0008284 | | 6/1983 |
| EP | 0448714 | | 10/1991 |
| EP | 0728860 | | 8/1996 |
| EP | 0758693 | | 2/1997 |
| EP | 0818289 | A2 | 1/1998 |
| EP | 0279950 | | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 1462349 | | 2/1967 |
| FR | 2046671 | | 3/1971 |
| FR | 2171172 | | 9/1973 |
| FR | 2457651 | | 12/1980 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| NL | 7304678 | | 10/1974 |
| WO | 9003744 | | 4/1990 |
| WO | WO199843506 | | 10/1998 |
| WO | 0032861 | | 6/2000 |
| WO | 0231247 | | 4/2002 |
| WO | WO2003013301 | | 2/2003 |
| WO | WO2004089609 | | 10/2004 |
| WO | WO2007139567 | | 12/2007 |
| WO | WO2007140055 | | 12/2007 |
| WO | WO2012125473 | A3 | 9/2012 |

OTHER PUBLICATIONS

The First Office Action dated Apr. 14, 2015 for Chinese Application No. 201310636770.0 filed Dec. 2, 2013.

Declaration of Dr. Edward C. Frederick from the US Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

Office Action dated Jun. 25, 2015 for Taiwan Application No. 102142345 filed Nov. 20, 2013.

Office Action from Taiwan Patent Application No. 102221739, dated Apr. 16, 2014.

International Search Report and Written Opinion in connection with PCT/US2009/056795 dated Apr. 20, 2010.

International Search Report and Written Opinion in connection with PCT/US2012/028576 dated Oct. 1, 2012.

International Search Report and Written Opinion in connection with PCT/US2012/028559 dated Oct. 19, 2012.

International Search Report and Written Opinion in connection with PCT/US2012/028534 dated Oct. 17, 2012.

Utility U.S. Appl. No. 13/048,514, filed Mar. 15, 2011.

Utility U.S. Appl. No. 13/529,381, filed Jun. 12, 2012.

Utility U.S. Appl. No. 13/686,048, filed Nov. 27, 2012.

Utility U.S. Appl. No. 13/691,316, filed Nov. 30, 2012.

International Search Report and Written Opinion for International Application No. PCT/US2013/071364, dated Mar. 13, 2014.

Letter from Bruce Huffa dated Dec. 23, 2013 (71 Pages).

* cited by examiner

ARTICLE OF FOOTWEAR INCORPORATING A KNITTED COMPONENT

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each impart different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each impart different properties to various areas of the footwear.

SUMMARY

An article of footwear may have an upper with a knitted component. In some configurations, the knitted component may include regions with different degrees of stretch-resistance. In some configurations, the knitted component forms a collar with a half-gauge knit. In some configurations, the upper includes a strand with sections that are inlaid within the knitted component, and the sections are positioned immediately adjacent to each other. In some configurations, the strand forms a plurality of loops, pairs of the loops are positioned immediately adjacent to each other, and a lace extends through the pairs of the loops. Additionally, in some configurations, the knitted component includes a thermoplastic polymer material, and the strand is unbonded to the thermoplastic polymer material.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
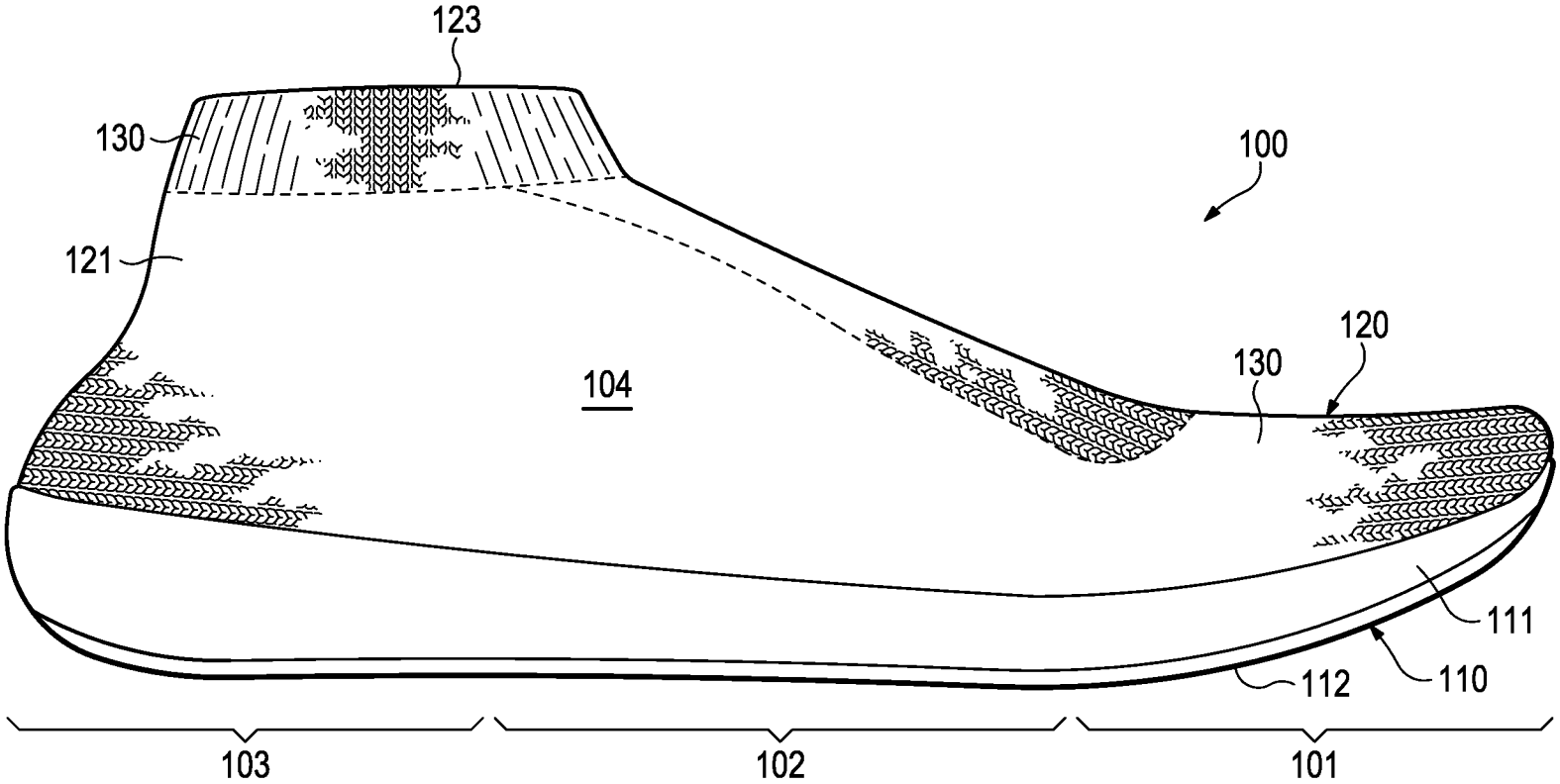
FIG. 1 is a lateral side elevational view of a first configuration of an article of footwear.
Figure 2:
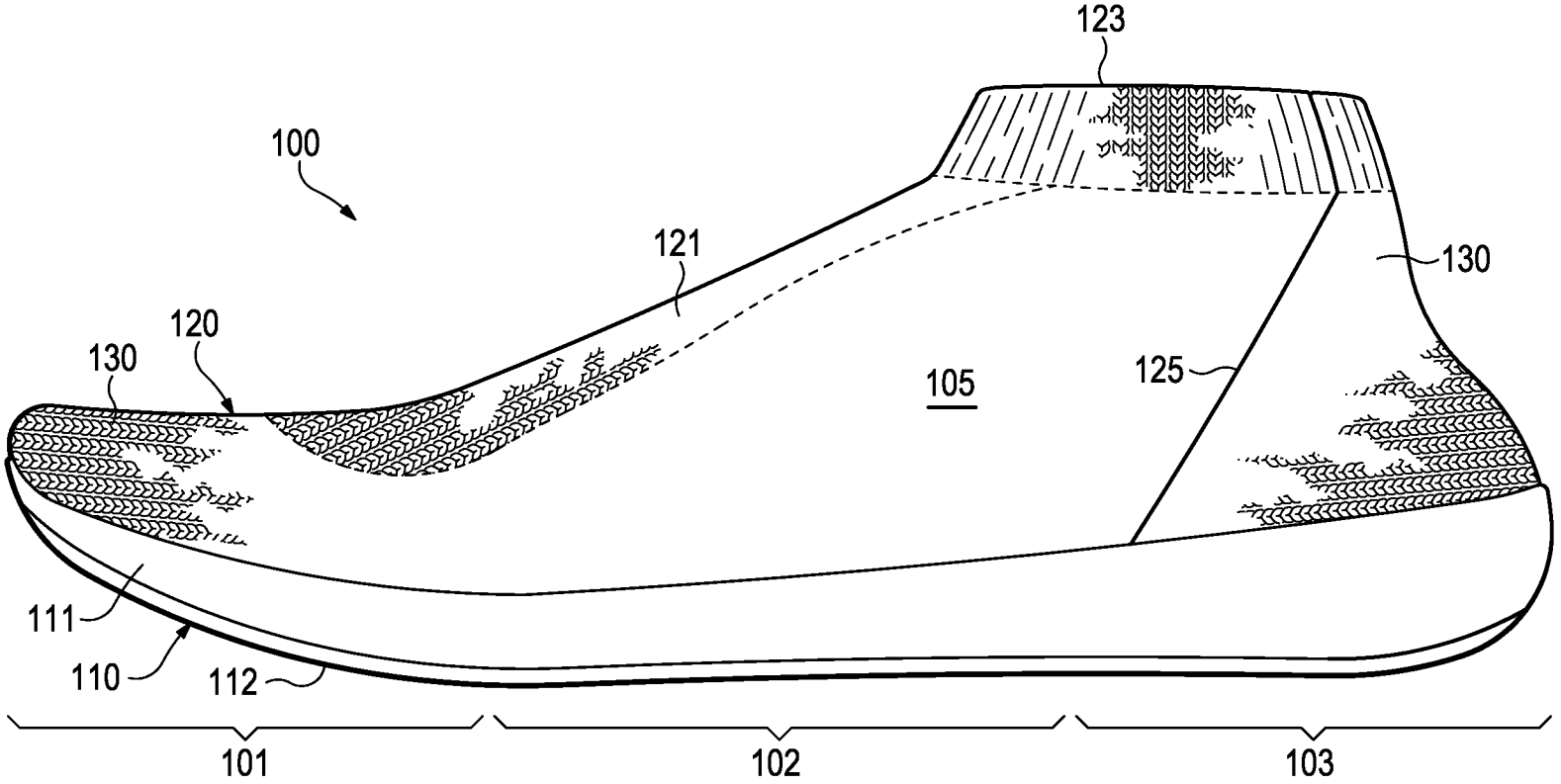
FIG. 2 is a medial side elevational view of the first configuration of the article of footwear.
Figure 3:
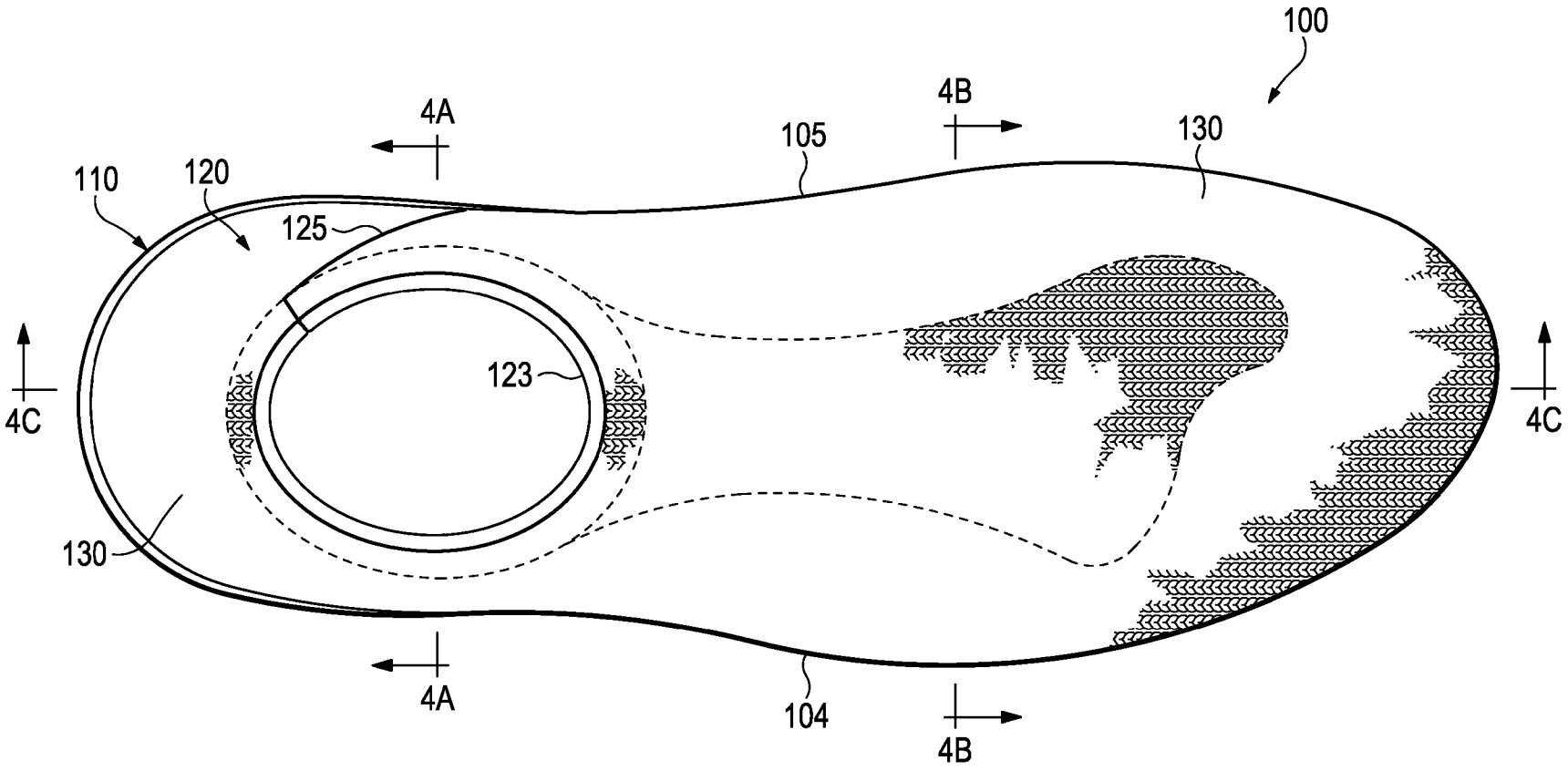
FIG. 3 is a top plan view of the first configuration of the article of footwear.

The following discussion and accompanying figures disclose an article of footwear having an upper that includes a knitted component. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, soccer shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

As a first example, an article of footwear 100 is depicted in FIGS. 1-4C as including a sole structure 110 and an upper 120. Whereas sole structure 110 is located under and supports a foot of a wearer, upper 120 provides a comfortable and secure covering for the foot. As such, the foot may be located within a void in upper 120 to effectively secure the foot within footwear 100 or otherwise unite the foot and footwear 100. Moreover, sole structure 110 is secured to a lower area of upper 120 and extends between the foot and the ground to attenuate ground reaction forces (i.e., cushion the foot), provide traction, enhance stability, and influence the motions of the foot, for example.

For reference purposes, footwear 100 may be divided into three general regions: a forefoot region 101, a midfoot region 102, and a heel region 103. Forefoot region 101 generally encompasses portions of footwear 100 corresponding with forward portions of the foot, including the toes and joints connecting the metatarsals with the phalanges. Midfoot region 102 generally encompasses portions of footwear 100 corresponding with middle portions of the foot, including an arch area. Heel region 103 generally encompasses portions of footwear 100 corresponding with rear portions of the foot, including the heel and calcaneus bone. Footwear 100 also includes a lateral side 104 and a medial side 105, which extend through each of regions 101-103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100, regions 101-103 and sides 104-105 may also be applied to sole structure 110, upper 120, and individual elements thereof.

The primary elements of sole structure 110 are a midsole 111, an outsole 112, and a sockliner 113. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 112 is secured to a lower surface of midsole 111 and may be formed from a wear-resistant rubber material that is textured to impart traction. Sockliner 113 is located within the void in upper 120 and is positioned to extend under a lower surface of the foot to enhance the comfort of footwear 100. As another example, sole structure 110 may have a configuration disclosed in U.S. Pat. No. 6,990,755 to Hatfield, et al., which issued on 31 Jan. 2006, which is entirely incorporated herein by reference. Although these configurations for sole structure 110 provide examples of sole structures that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 extends through each of regions 101-103, along both lateral side 104 and medial side 105, over forefoot region 101, around heel region 103, and over an upper surface of sole structure 110. When the foot is located within the void, which is shaped to accommodate the foot, upper 120 extends along a lateral side of the foot, along a medial side of the foot, over the foot, around the heel, and under the foot. Upper 120 includes an exterior surface 121 and an opposite interior surface 122. Whereas exterior surface 121 faces outward and away from footwear 100, interior surface 122 faces inward and defines a majority or a relatively large portion of the void in upper 120. Moreover, interior surface 121 may lay against the foot or a sock covering the foot. Upper 120 also includes a collar 123 that is primarily located in heel region 103 and defines an opening to the void in upper 120, thereby providing the foot with access to the void. That is, the foot may be inserted into upper 120 and withdrawn from upper 120 through the opening formed by collar 123.

Figure 4A:
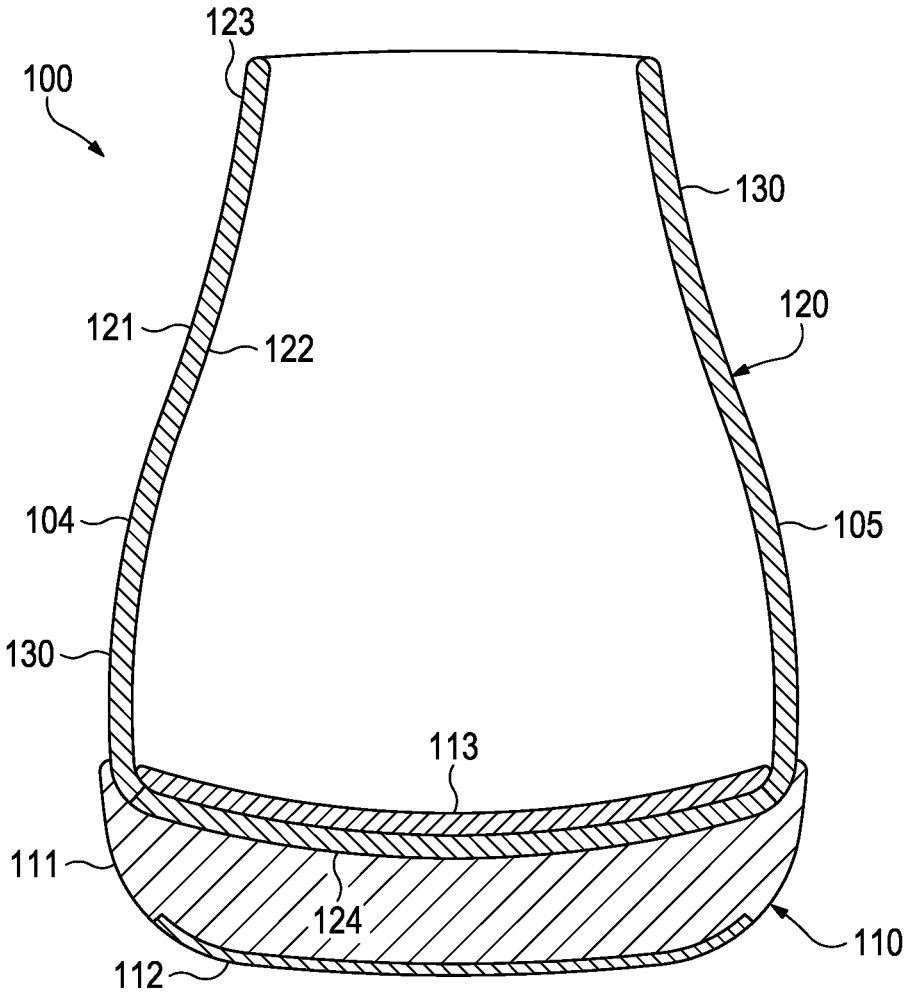
FIGS. 4A-4C are cross-sectional views of the first configuration of the article of footwear, as respectively defined by section lines 4A-4C in FIG. 3.
Figure 4B:
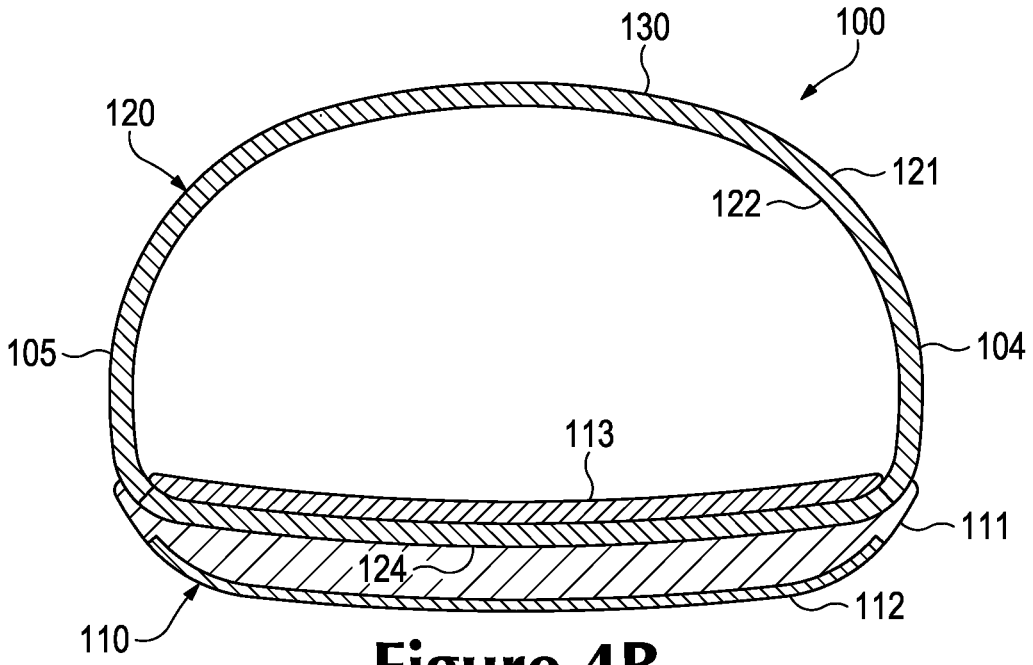
Figure 4C:
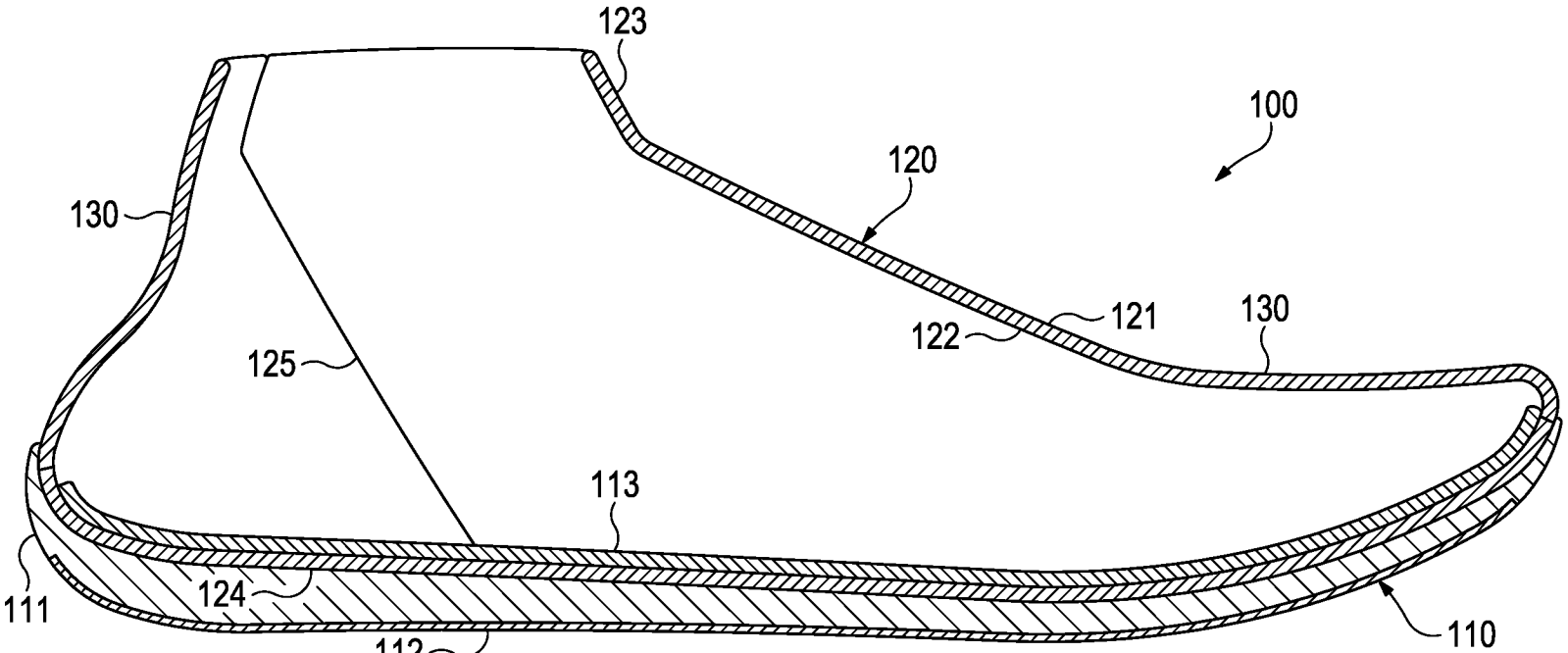

A majority of upper 120 is formed from a knitted component 130, which will be discussed in greater detail below. Although knitted component 130 is depicted as forming substantially all of upper 120, including both of surfaces 121 and 122 and collar 123, a variety of additional elements may be incorporated into upper 120. For example, a strobel sock 124 is secured to knitted component 130 and forms a majority of the portion of upper 120 that extends under the foot, as depicted in FIGS. 4A-4C. In this configuration, sockliner 113 extends over strobel sock 124 and forms a surface upon which the foot rests. As an alternative, knitted component 130 may extend under the foot, thereby replacing some or all of strobel sock 124. In addition, a seam 125 extends through heel region 103 on medial side 105 to join edges of knitted component 130. Although knitted component 130 forms portions of both of surfaces 121 and 122, a polymer layer or a skin layer may be bonded with areas of knitted component 130, as disclosed in U.S. Patent Application Publication 2012/0246973 to Dua, which is entirely incorporated herein by reference. In further configurations, upper 120 may also include one or more of (a) a lace that assists with tightening upper 120 around the foot, (b) a heel counter in heel region 103 for enhancing stability, (c) a toe guard in forefoot region 101 that is formed of a wear-resistant material, and (d) logos, trademarks, and placards with care instructions and material information. Accordingly, upper 120 may incorporate a variety of other features and elements, in addition to the features and elements discussed herein and shown in the figures.

Knitted Component Configuration

Knitted component 130 is formed through a knitting process, such as flat knitting, and extends throughout upper 120. Although seams may be present in areas of knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. Although portions of knitted component 130 may be joined to each other (e.g., edges of knitted component 130 being joined together, as at seam 125) following the knitting process, knitted component 130 remains formed of unitary knit construction because it is formed as a one-piece knit element. Moreover, knitted component 130 remains formed of unitary knit construction when other elements (e.g., strobel sock 124, a lace, logos, trademarks, placards) are added following the knitting process.

Knitted component 130 is formed as a knit element and may incorporate various types and combinations of stitches and yarns. With regard to stitches, the yarn forming knitted component 130 may have one type of stitch in one area of knitted component 130 and another type of stitch in another area of knitted component 130. Depending upon the types and combinations of stitches utilized, areas of knitted component 130 may have a plain knit structure, a mesh knit structure, or a rib knit structure, for example. The different types of stitches may affect the physical properties of knitted component 130, including aesthetics, stretch, thickness, air permeability, and abrasion-resistance. That is, the different types of stitches may impart different properties to different areas of knitted component 130. With regard to yarns, knitted component 130 may have one type of yarn in one area of knitted component 130 and another type of yarn in another area of knitted component 130. Depending upon various design criteria, knitted component 130 may incorporate yarns with different deniers, materials (e.g., cotton, elastane, polyester, rayon, wool, and nylon), and degrees of twist, for example. The different types of yarns may affect the physical properties of knitted component 130, including aesthetics, stretch, thickness, air permeability, and abrasion-resistance. That is, the different types of yarns may impart different properties to different areas of knitted component 130. By combining various types and combinations of stitches and yarns, each area of knitted component 130 may have specific properties that enhance the comfort, durability, and performance of footwear 100.

Figure 5:
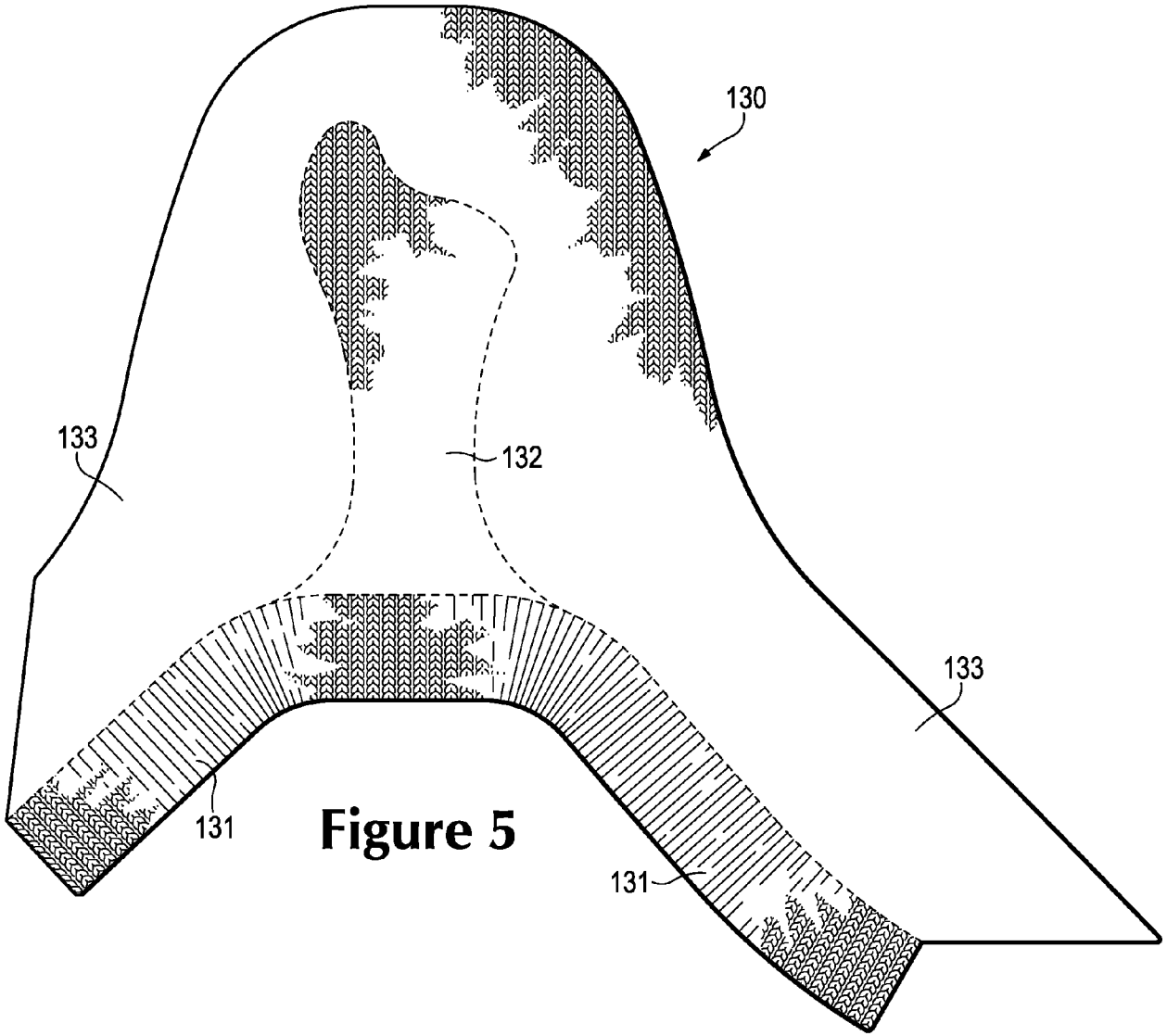
FIG. 5 is a top plan view of a knitted component from an upper of the first configuration of the article of footwear.

Knitted component 130 is depicted separate from footwear 100 and in a planar or flat configuration in FIG. 5. As discussed above, each area of knitted component 130 may have specific properties, depending upon the types and combinations of stitches and yarns that are utilized during the knitting process. Although the properties in areas of knitted component 130 may vary considerably, knitted component is depicted as including a first or collar region 131, a second or central region 132, and a third or peripheral region 133, each of which have different properties and are formed of unitary knit construction. In general, for example, collar region 131 has a greater ability to stretch than central region 132, and central region 132 has greater ability to stretch than peripheral region 133. That is, a tensile force acting upon collar region 131 will cause greater elongation or stretch in knitted component 130 than the same tensile force acting upon central region 132. Similarly, a tensile force acting upon central region 132 will cause greater elongation or stretch in knitted component 130 than the same tensile force acting upon peripheral region 133. Said another way, collar region 131 has less stretch-resistance than central region 132, and central region 132 has less stretch-resistance than peripheral region 133. It should be noted that although a dashed line is utilized to separate and define regions 131-133, the dashed line may be for reference not visible in some configurations of knitted component 130.

Collar region 131 corresponds with the position of collar 123 in upper 120 and forms a circular or tubular structure. When footwear 100 is worn, collar region 131 extends around or encircles an ankle of the wearer and may lay against the ankle. As noted above, collar region 131 exhibits a greater ability to stretch than both of regions 132 and 133. An advantage of imparting a relatively small stretch-resistance to collar region 131 is that this area of knitted component 130 will elongate or otherwise stretch as the foot is inserted into upper 120 and withdrawn from upper 120 through the opening formed by collar 123. Additionally, collar region 131 may remain in a partially stretched state and lay against the ankle when footwear 100 is worn, thereby preventing dirt, pebbles, and other debris from entering footwear 100 through collar 123.

Figure 6A:
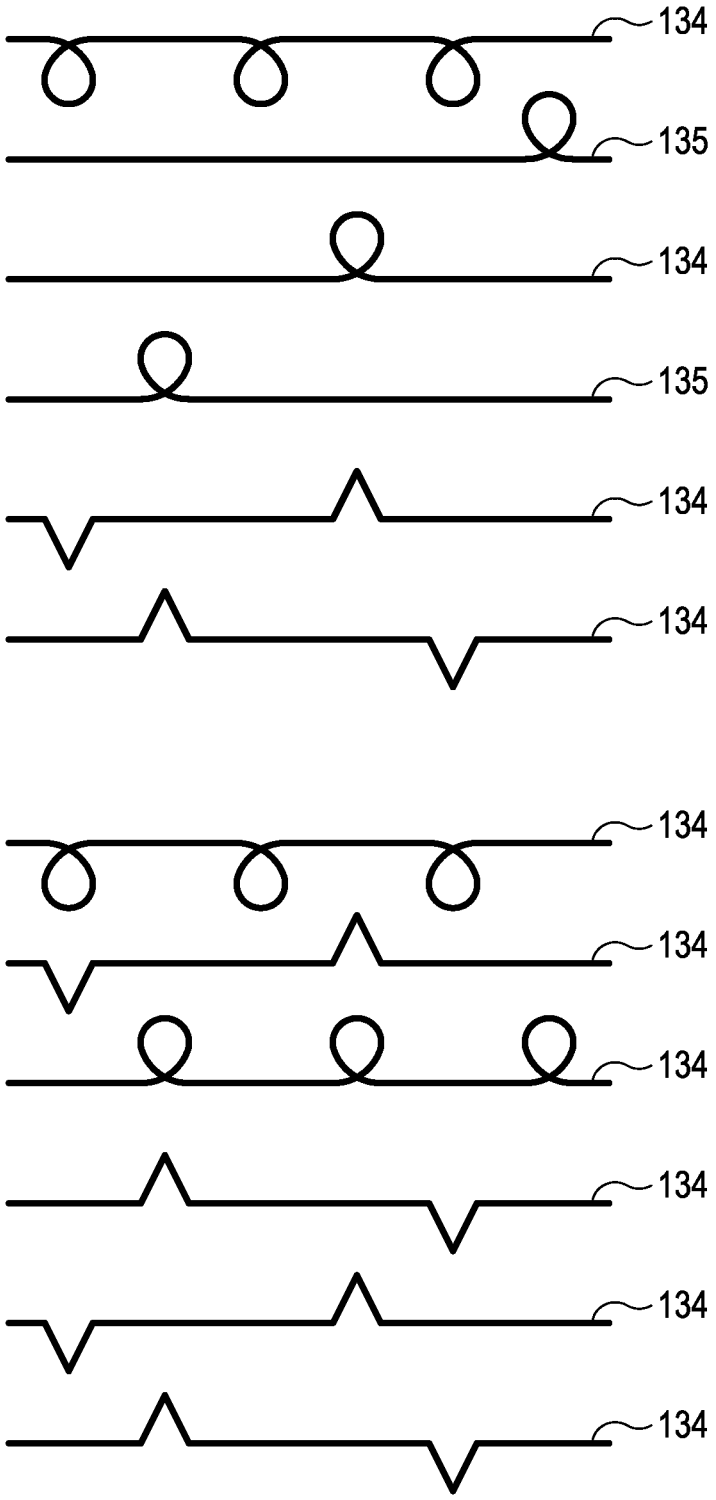
FIGS. 6A-6C are loop diagrams depicting knit structures from the knitted component.

Various types of stitches and yarns may be utilized for collar region 131. As an example, FIG. 6A depicts a loop diagram representing a knit structure for collar region 131 that is formed from a first yarn 134 and a second yarn 135. In order to impart stretch to collar region 131, the loop diagram indicates that collar region 131 is formed as a half-gauge knit. That is, the loops and tuck stitches formed by yarns 134 and 135 are knitted on every other needle to form gaps or ribs in the knit structure, thereby facilitating expansion or stretch. In some configurations, forming collar region 131 as a half-gauge knit forms a ribbed structure in knitted component 130. To impart additional stretch to collar region 131, first yarn 134 may be an elastic yarn, such as 210 denier elastane (e.g., spandex) covered with two ends of 150 denier polyester yarn. In addition, second yarn 135 may be two ends of 150 denier texturized polyester yarn.

Central region 132 extends outward from collar region 131 and toward a portion of knitted component 130 that is located in forefoot region 101, thereby corresponding with a throat area of upper 120. When footwear 100 is worn, central region 132 extends over an upper surface of the foot and may lay against the upper surface of the foot. As noted above, central region 132 exhibits greater stretch-resistance than collar region 131, but has a lesser stretch-resistance than peripheral region 133. An advantage of imparting a moderate degree of stretch-resistance to central region 132 is that this area of knitted component 130 will expand or otherwise stretch as the foot is inserted into upper 120, thereby accommodating feet with various proportions, such as girth and width. Additionally, central region 132 may remain in a partially stretched state and lay against the upper surface of the foot when footwear 100 is worn, thereby ensuring a secure fit during running or walking.

Figure 6B:
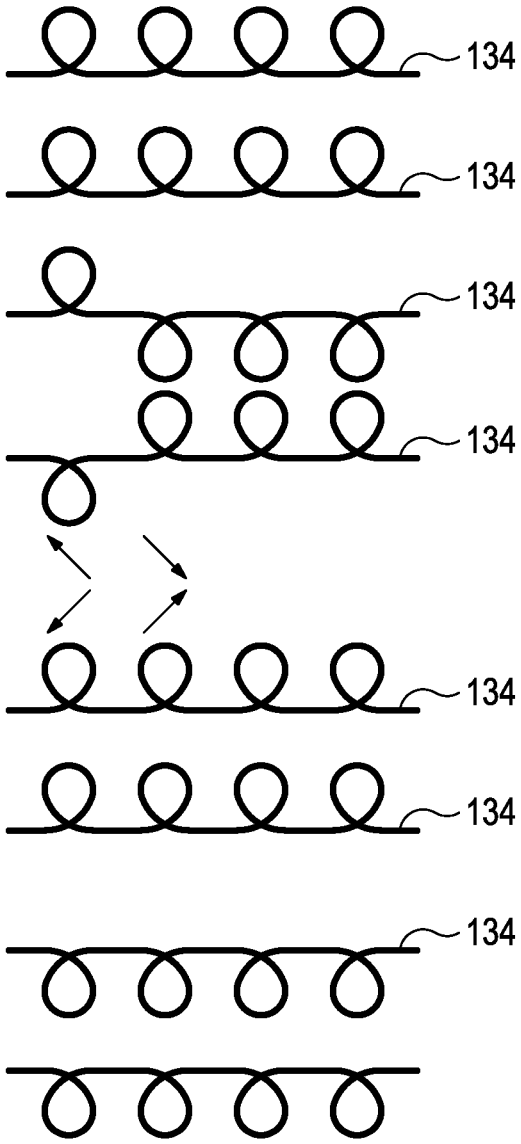

Various types of stitches and yarns may be utilized for central region 132. As an example, FIG. 6B depicts a loop diagram representing a knit structure for central region 132 that is formed from first yarn 134. Although the loop diagram indicates that central region 132 is formed as a full-gauge knit, first yarn 134 may be an elastic yarn that imparts the moderate degree of stretch-resistance to central region 132. As noted above, first yarn 134 may be 210 denier elastane covered with two ends of 150 denier polyester.

Peripheral region 133 forms a remainder of knitted component 130 and extends at least partially around central region 132, thereby being located in a periphery of knitted component 130. When incorporated into footwear 100, peripheral region 133 extends through each of regions 101-103, along both lateral side 104 and medial side 105, over forefoot region 101, around heel region 103. Moreover, when footwear 100 is worn, peripheral region 133 extends along a lateral side of the foot, along a medial side of the foot, over the foot, and around the heel. As noted above, peripheral region 133 exhibits greater stretch-resistance than both of regions 131 and 132. Moreover, peripheral region 133 may exhibit relatively little or no stretch when tensile forces are applied. An advantage of imparting a relatively small degree of stretch to peripheral region 133 is that this area of knitted component 130 resists stretch in upper 120 and ensures a secure fit during running or walking.

Figure 6C:
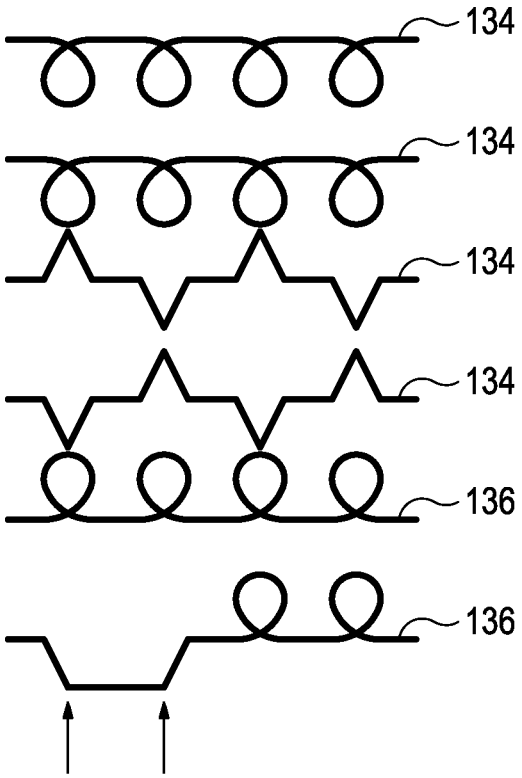
Figure 7:
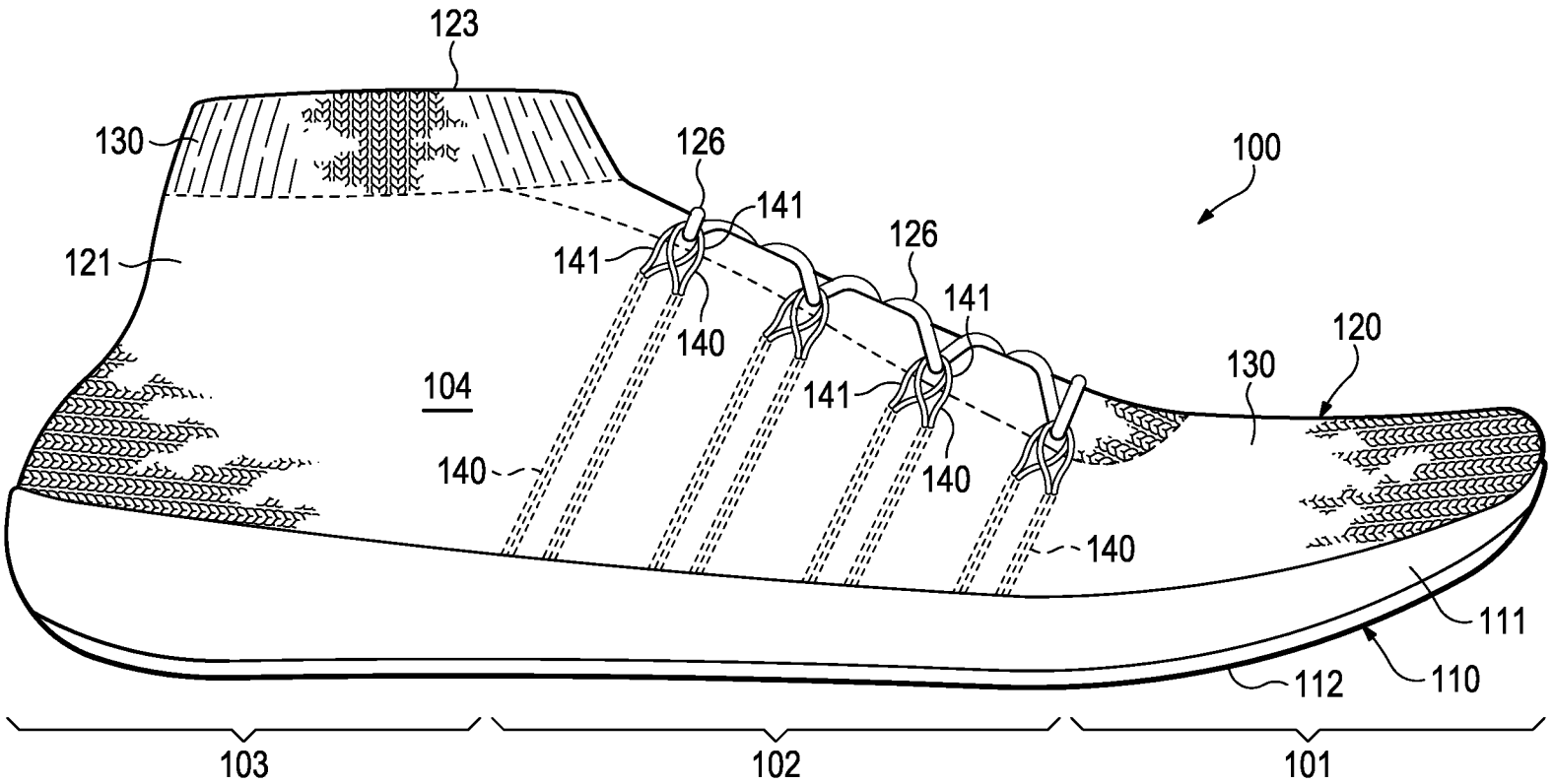
FIG. 7 is a lateral side elevational view of a second configuration of the article of footwear.
Figure 8:
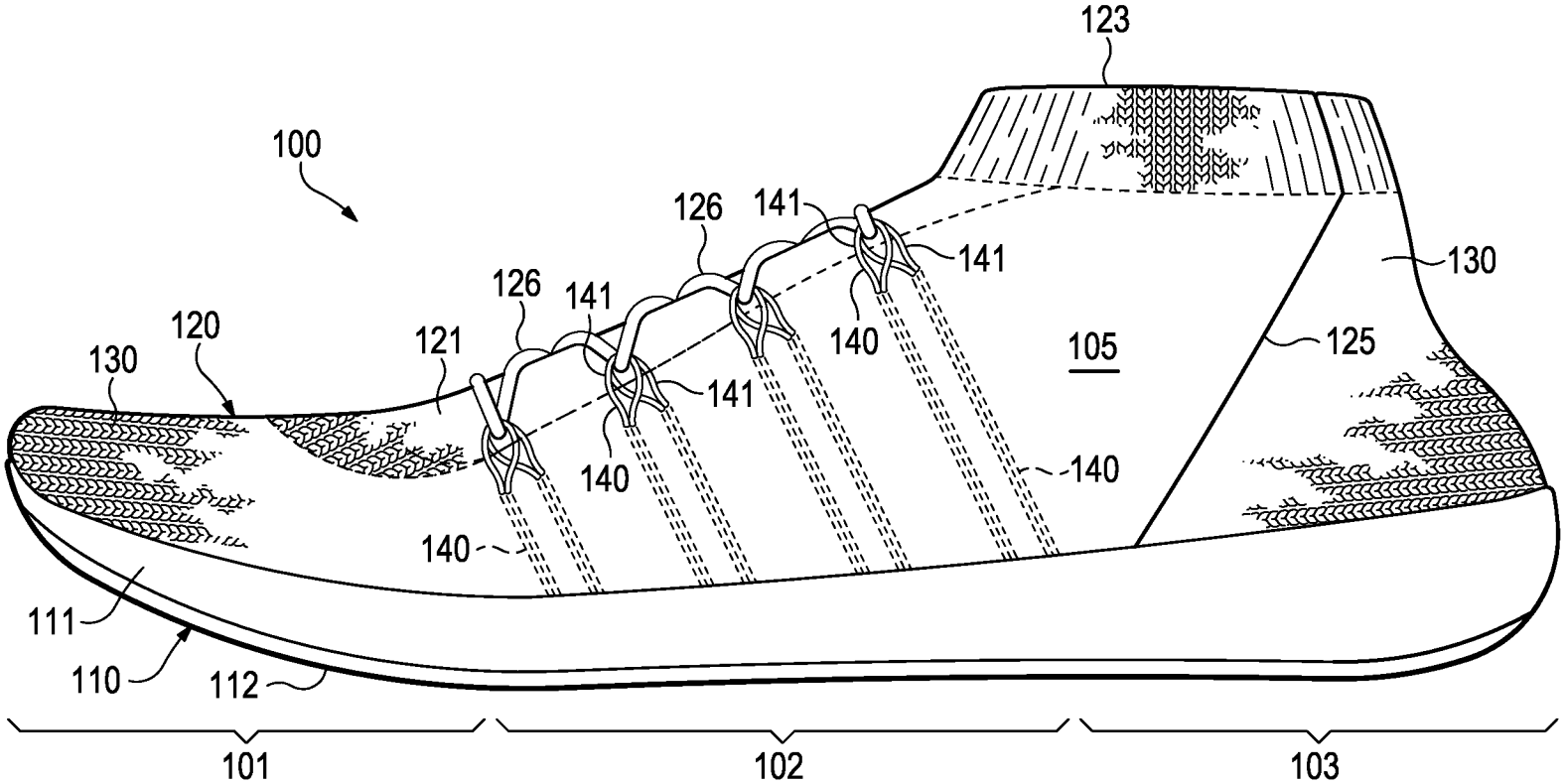
FIG. 8 is a medial side elevational view of the second configuration of the article of footwear.
Figure 9:
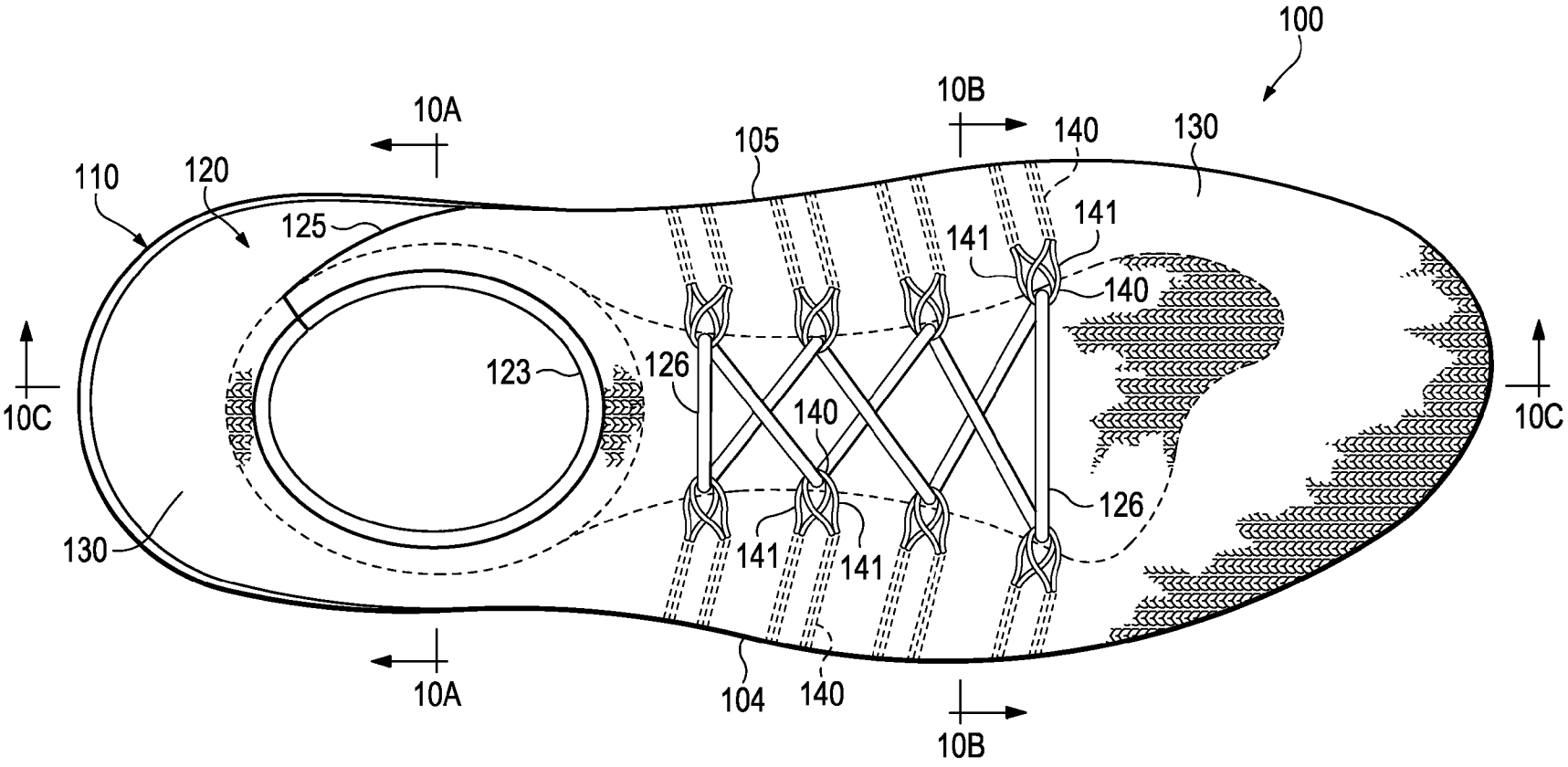
FIG. 9 is a top plan view of the second configuration of the article of footwear.
Figure 10A:
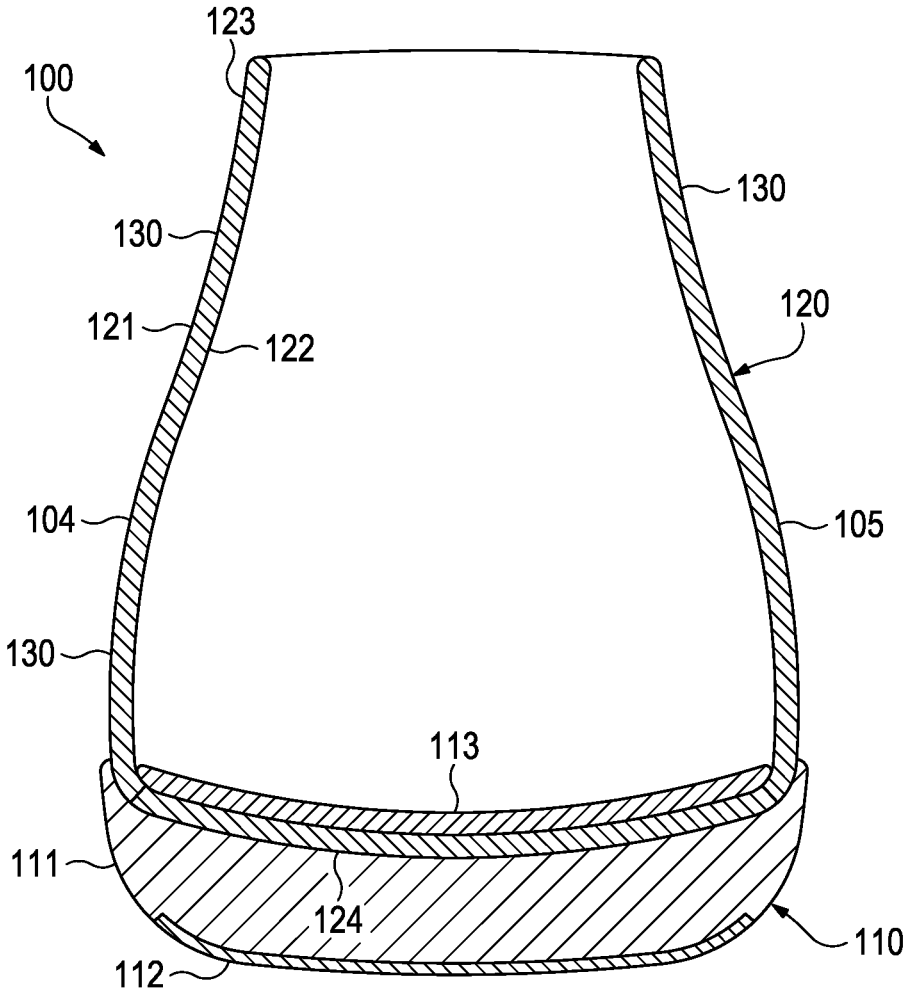
FIGS. 10A-10C are cross-sectional views of the second configuration of the article of footwear, as respectively defined by section lines 10A-100 in FIG. 9.
Figure 10B:
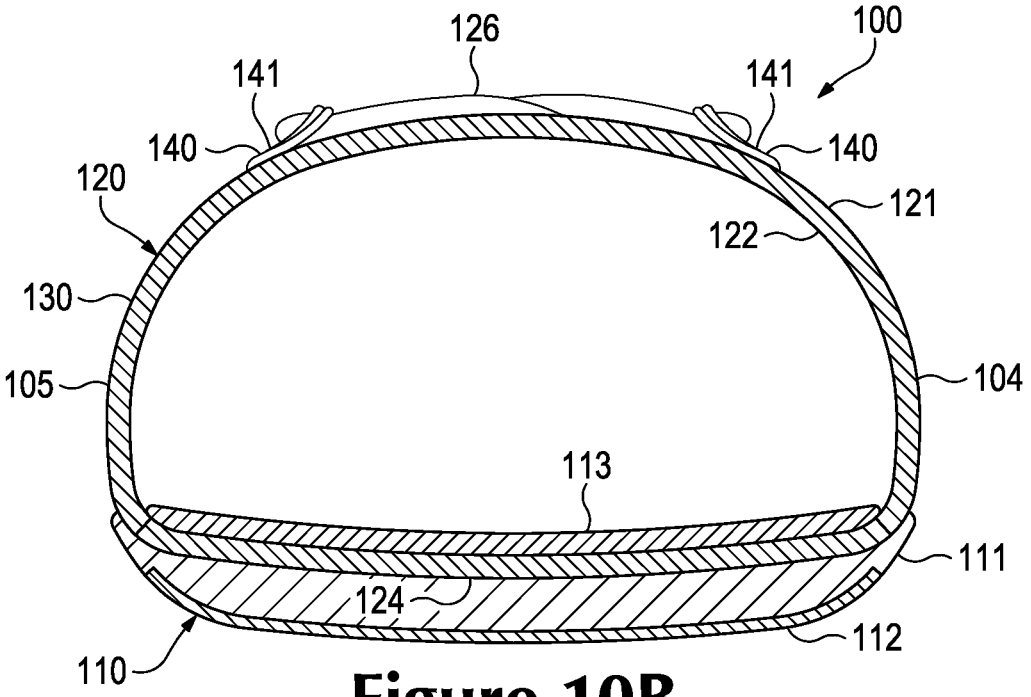
Figure 10C:
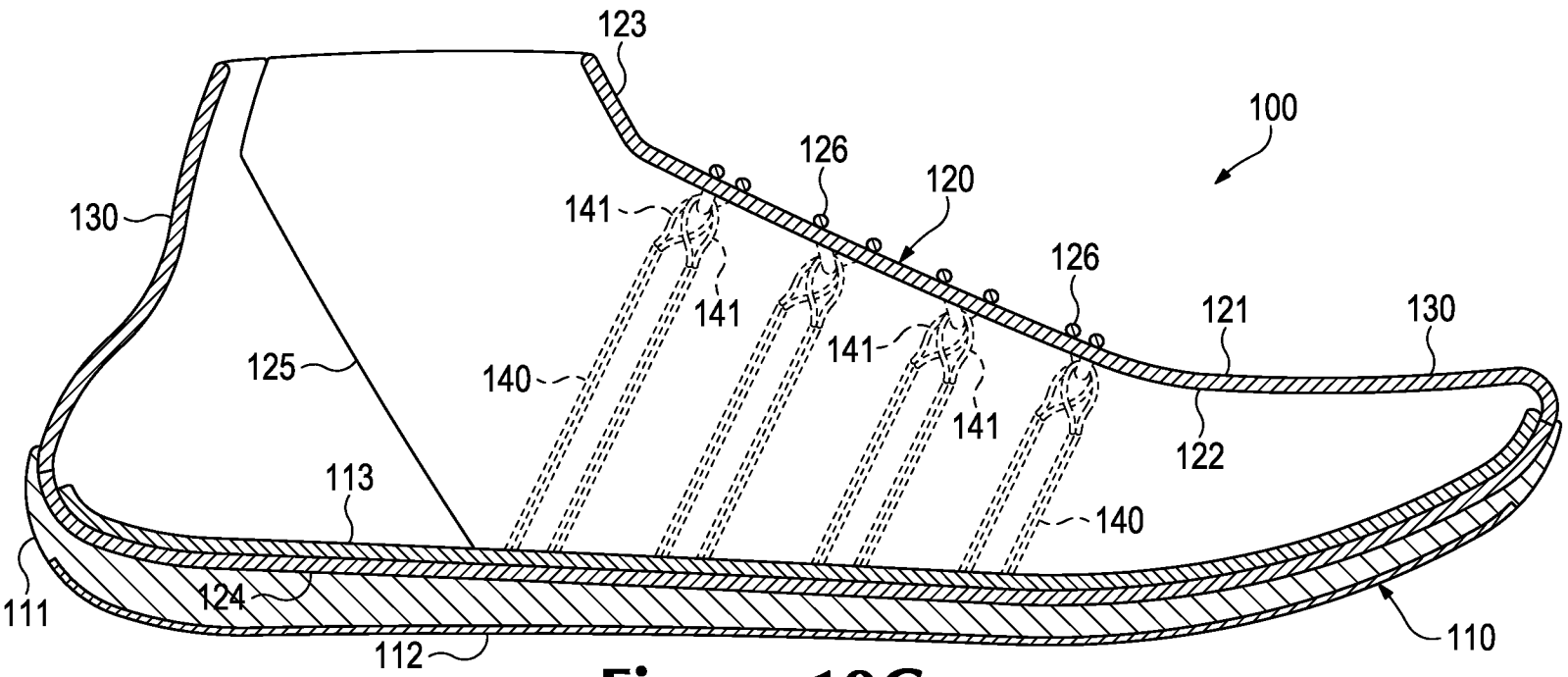

Various types of stitches and yarns may be utilized for peripheral region 133. As an example, FIG. 6C depicts a loop diagram representing a knit structure for peripheral region 133 that is formed from first yarn 134 and a third yarn 136. Although the first yarn 134 may be an elastic yarn, the greater stretch-resistance in peripheral region 133 may be a product of (a) a full-gauge knit depicted in the loop diagram and (b) thermoplastic features of third yarn 136. That is, third yarn 136 may incorporate a fusible or thermoplastic polymer material, which softens or melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, thermoplastic polymer materials are often used to join two objects or elements together. In this case, the thermoplastic polymer material in third yarn 136 may be utilized to join (a) portions of third yarn 136 to portions of first yarn 134 and (b) portions of third yarn 136 to other portions of third yarn 136. Accordingly, the thermoplastic polymer material, which may be thermoplastic polyurethane, fuses or bonds with the knit structure and stabilizes peripheral region 133, thereby minimizing stretch in peripheral region 133. As an example, third yarn 136 may be two ends of 20 denier elastane covered with 150 denier texturized polyester and a fusible or thermoplastic polymer material. It should be noted that, in many configurations of footwear 100, the thermoplastic polymer material is substantially absent from collar region 131 and central region 132.

Although knitted component 130 may be formed through a variety of different knitting processes and using a variety of different knitting machines, flat knitting (i.e., the use of a flat knitting machine) has the capability of forming knitted component 130 to have the various features discussed above. Flat knitting is a method for producing a knitted material that is turned periodically (i.e., the material is knitted from alternating sides). The two sides (otherwise referred to as faces) of the material are conventionally designated as the right side (i.e., the side that faces outwards, towards the viewer) and the wrong side (i.e., the side that faces inwards, away from the viewer). Additional information on flat knitting and processes that may be utilized to form knitted component 130 may be found in U.S. Patent Application Publication 2012/0233882 to Huffa, et al., which is entirely incorporated herein by reference. Although flat knitting provides a suitable manner for forming knitted component 130, a variety of other knitting processes may also be utilized, depending upon the features that are incorporated into knitted component 130. Examples of other knitting processes that may be utilized include wide tube circular knitting, narrow tube circular knit jacquard, single knit circular knit jacquard, double knit circular knit jacquard, warp knit tricot, warp knit raschel, and double needle bar raschel.

Inlaid Lace Loop Configuration

Another configuration of footwear 100 is depicted in FIGS. 7-10C as having many or all of the features discussed above. As such, knitted component 130 (a) is formed through a knitting process, such as flat knitting, and extends throughout upper 120, (b) may be formed of unitary knit construction, (c) is formed as a knit element and may incorporate various types and combinations of stitches and yarns. In addition, knitted component 130 may include each of collar region 131, central region 132, and peripheral region 133, as well as the relative degrees of stretch discussed above. As an additional feature, this configuration of footwear 100 includes an inlaid strand 140 that forms various lace loops 141, which are configured to receive a lace 126, which is depicted as passing through the various lace loops 141. As in some conventional articles of footwear, lace 126 passes across upper 120 and between lace loops 141 that are located along opposite sides of upper 120. When using footwear 100, lace 126 permits the wearer to modify dimensions of upper 120 to accommodate the proportions of the foot. More particularly, lace 126 may be manipulated in a conventional manner to permit the wearer to (a) tighten upper 120 around the foot and (b) loosen upper 120 to facilitate insertion and withdrawal of the foot from the void in upper 120 (i.e., through the opening formed by collar 123).

Portions of inlaid strand 140 are located within knitted component 130 and may be inlaid into the structure of knitted component 130 during the knitting process. U.S. Patent Application Publication 2012/0233882 to Huffa, et al., which was referenced above and incorporated herein, provides discussion of the manner in which knitted component 130 may be formed, including the process of inlaying or otherwise locating inlaid strand 140 within knitted component 130. Given that inlaid strand 140 is incorporated into knitted component 130 during the knitting process, knitted component 130 and inlaid strand 140 may be formed of unitary knit construction. That is, knitted component 130 and inlaid strand 140 are formed as a one-piece element through the knitting process.

Inlaid strand 140 repeatedly-passes between (a) a throat area of upper 120, which corresponds with the location of lace 126 and the upper surface of the foot and (b) a lower area of upper 120, which is adjacent to where sole structure 110 is secured to upper 120. Although portions of inlaid strand 140 are located within knitted component 130 between the throat area and the lower area, other portions of inlaid strand 140 are exposed or located exterior of knitted component 130 in the throat area to form lace loops 141. In this configuration, inlaid strand 140 is tensioned when lace 126 is tightened, and inlaid strand 140 resists stretch in upper 120. Moreover, inlaid strand 140 assists with securing upper 120 around the foot and operates in connection with lace 126 to enhance the fit of footwear 100.

Figure 11:
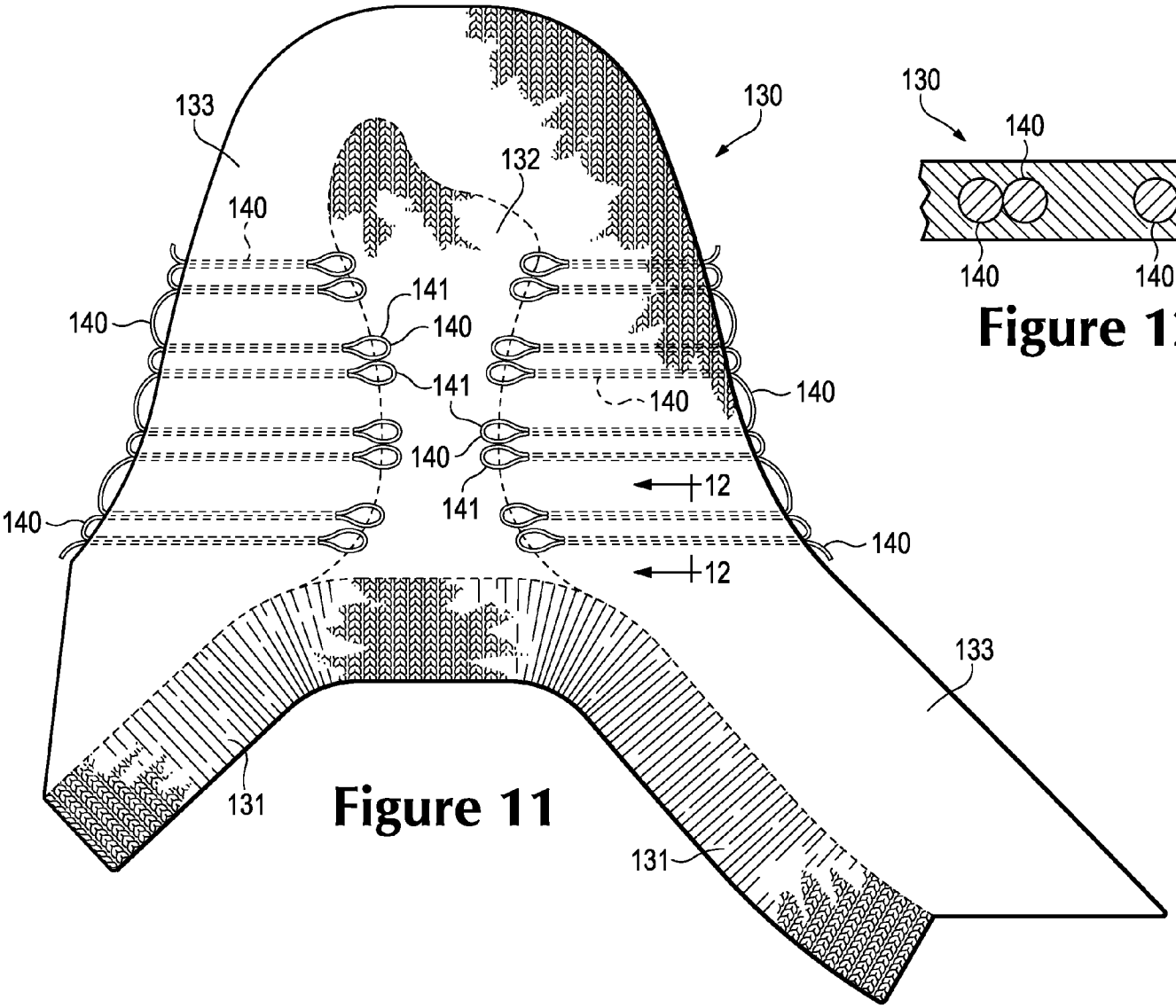
FIG. 11 is a top plan view of a knitted component from an upper of the second configuration of the article of footwear.

Knitted component 130 and inlaid strand 140 are depicted separate from footwear 100 and in a planar or flat configuration in FIG. 11. Although the specific locations of inlaid strand 140 may vary considerably, inlaid strand 140 is depicted as being primarily located in peripheral region 133. As discussed above, peripheral region 133 exhibits a greater stretch-resistance than both of regions 132 and 133 and may exhibit relatively little or no stretch when placed in tension. In comparison with peripheral region 133, inlaid strand 140 may exhibit an even greater resistance to stretch. That is, inlaid strand 140 may stretch less than peripheral region 133 when subjected to the same tensile force. Given that numerous sections of inlaid strand 140 extend from the throat area to the lower area of upper 120, inlaid strand 140 imparts stretch-resistance to the portion of upper 120 between the throat area and the lower area. Moreover, placing tension upon lace 126 may impart tension to inlaid strand 140, thereby inducing the portion of upper 120 between the throat area and the lower area to lay against the foot. As such, inlaid strand 140 operates in connection with lace 126 to enhance the fit of footwear 100.

Figure 12:
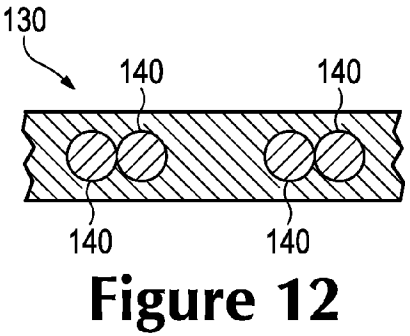
FIG. 12 is a cross-sectional view of the knitted component depicted in FIG. 11, as defined by section line 12 in FIG. 11.

Referring to FIG. 12, inlaid strand 140 is depicted as being located within knitted component 130 and between opposite surfaces of knitted component 130. Given that the surfaces of knitted component 130 may also form each of surfaces 121 and 122 when incorporated into footwear 100, inlaid strand 140 will also be located between surfaces 121 and 122. Although each of the sections of inlaid strand 140 that are located within knitted component 130 may be spaced from each other, the sections of inlaid strand 140 that form a single lace loop 141 are depicted as being located immediately adjacent to each other. As defined herein, sections of inlaid strand 140 are "immediately adjacent" to each other when located within two millimeters of each other. In this configuration, the sections of inlaid strand that extend downward from each lace loop 141 and toward sole structure 110 are immediately adjacent to each other. In some configurations, sections of inlaid strand 140 that are immediately adjacent to each other may be in contact or may be separated from each other by one or two yarns, for example. Moreover, the structure knitted component 130 may define a tunnel or channel within upper 120, and the sections of inlaid strand that extend downward from each lace loop 141 may be located within the same tunnel.

As discussed above, portions of inlaid strand 140 are located within knitted component 130, and other portions of inlaid strand 140 are exposed or located exterior of knitted component to form lace loops 141. For each lace loop 141, a first section of inlaid strand 140 is located or inlaid within knitted component 130, a second section of inlaid strand 140 forms one of lace loops 141, and a third section of inlaid strand 140 is also located or inlaid within knitted component 130. Moreover, the first section and the third section are positioned immediately adjacent to each other and extend between the throat area and the lower area of upper 120. In some configurations, the first section and the third section may be located within the same tunnel or channel within knitted component 130.

Figure 13:
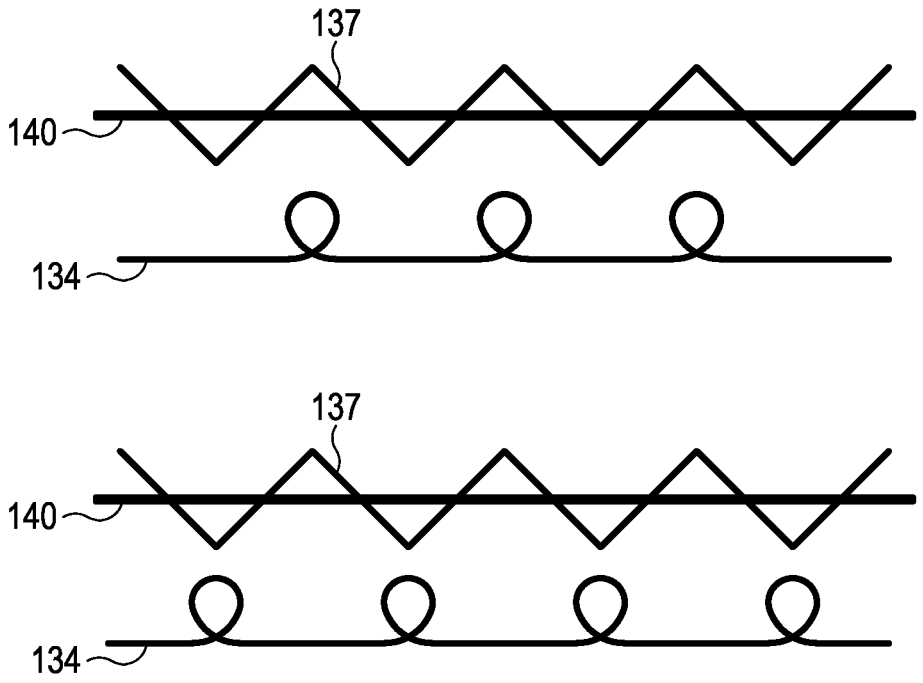
FIG. 13 is a loop diagram depicting a knit structure from the knitted component depicted in FIG. 11.

FIG. 13 depicts a loop diagram representing a knit structure for the areas that include inlaid strand 140. In addition to inlaid strand 140, a fourth yarn 137 may be located in this area and have two ends of 20 denier elastane covered with 150 denier texturized polyester. Fourth yarn 137 has a structure that is similar to third yarn 136, but without the fusible or thermoplastic polymer material. An advantage of this configuration is that inlaid strand 140 will remain unbonded to knitted component 130 or otherwise separate from knitted component 130 in peripheral region 133. Moreover, inlaid strand 140 may slide or move within knitted component 130, thereby (a) allowing the size of each lace loop 141 and (b) the tension in portions of inlaid strand 140 to be adjusted during the manufacturing process of footwear 100.

Another method of ensuring that inlaid strand 140 will remain unbonded to knitted component 130 or otherwise separate from knitted component 130 relates to the selection of material for inlaid strand 140. As an example, inlaid strand 140 may be formed from a nylon material that does not bond or join with some thermoplastic polymer materials, such as thermoplastic polyurethane. When inlaid strand 140 is formed from nylon, therefore, fourth yarn 137 may be replaced by third yarn 136, which includes the fusible or thermoplastic polymer material, and inlaid strand 140 will not bond with third yarn 136. An advantage of this method is that the number of different types of yarns that are utilized in knitted component 130 may be minimized, thereby enhancing manufacturing efficiency. Various coatings, such as polytetrafluoroethylene (PTFE), may also be utilized to inhibit bonding between inlaid strand 140 and the fusible or thermoplastic polymer material. As such, selecting inlaid strand 140 to have a material that is incompatible with the thermoplastic polymer material may ensure that inlaid strand 140 will remain unbonded to knitted component 130

In general, portions of knitted component 130 may include yarns that are at least partially formed from a thermoplastic polymer material. Knitted component 130 may be heated such that the thermoplastic polymer material bonds or fuses areas of knitted component 130, such as in peripheral region 133. More particularly, the thermoplastic polymer material may bond portions of the yarns together to form bonded or fused areas. In some configurations, the yarn with the thermoplastic polymer material may be bonded to itself in the fused areas. In other configurations, the yarn with the thermoplastic polymer material may be bonded to other yarns in the fused areas, which may or may not include a thermoplastic polymer material. In either scenario, however, various methods may be utilized to ensure that inlaid strand 140 remains unbonded to the thermoplastic polymer material. In one example, the knit structure of knitted component 130 places yarns without a thermoplastic polymer material immediately adjacent to inlaid strand 140, thereby forming a buffer between inlaid strand 140 and the thermoplastic polymer material. In another example, inlaid strand 140 may include a material that does not form a bond with the thermoplastic polymer material. Accordingly, various configurations and methods may be utilized to ensure that inlaid strand 140 will remain separate from or unbonded to the thermoplastic polymer material.

As with the yarns forming knitted component 130, the configuration of inlaid strand 140 may also vary significantly. In addition to yarn, inlaid strand 140 may have the configurations of a filament (e.g., a monofilament), thread, rope, webbing, cable, or chain, for example. In comparison with the yarns forming knitted component 130, the thickness of inlaid strand 140 may be greater. In some configurations, inlaid strand 140 may have a significantly greater thickness than the yarns of knitted component 130. Although the cross-sectional shape of inlaid strand 140 may be round, the cross-sectional shape may also be triangular, square, rectangular, elliptical, or irregular. Moreover, the materials forming inlaid strand 140 may include any of the materials for the yarns within knitted component 130, such as cotton, elastane, polyester, rayon, wool, and nylon. As noted above, inlaid strand 140 may exhibit greater stretch-resistance than knitted component 130. As such, suitable materials for inlaid strands 140 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread or cable having a diameter of 0.8 millimeters may also be utilized as inlaid strand 140.

Figure 14:
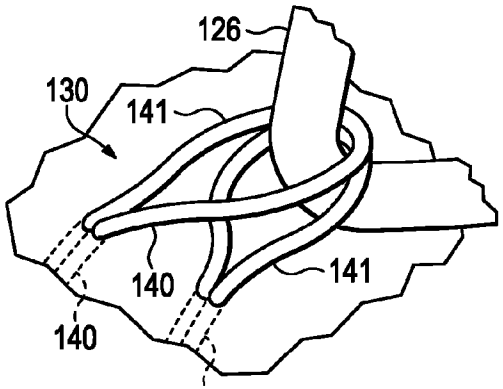
FIG. 14 is a perspective view of a portion of the upper of the second configuration of the article of footwear.

Lace 126, as noted above, passes across upper 120 and between lace loops 141 that are located along opposite sides of upper 120. In effect, lace 126 follows a zigzagging path across upper 120 and between the opposite sides of upper 120. At various locations on the opposite sides of upper 120, two lace loops 141 overlap each other or are positioned immediately adjacent to each other, as depicted in FIG. 14, and lace 126 passes through both lace loops 141 simultaneously. That is, pairs of lace loops 141 are utilized as lace-receiving elements at each location where lace 126 changes direction in repeatedly-passing across upper 120. With the pairs of lace loops 141 being in an overlapping configuration, each of the pairs of lace loops 141 are aligned to form an aperture, and lace 126 extends through the aperture. Although lace 126 may pass through a single lace loop 141 at each location, an advantage of utilizing pairs of lace loops 141 is that the effect of breakage of inlaid strand 140 may be minimized. That is, when the portion of inlaid strand 140 associated with one lace loop 141 breaks or otherwise fails, the other lace loop 141 may form a lace-receiving element at each location.

Figure 15:
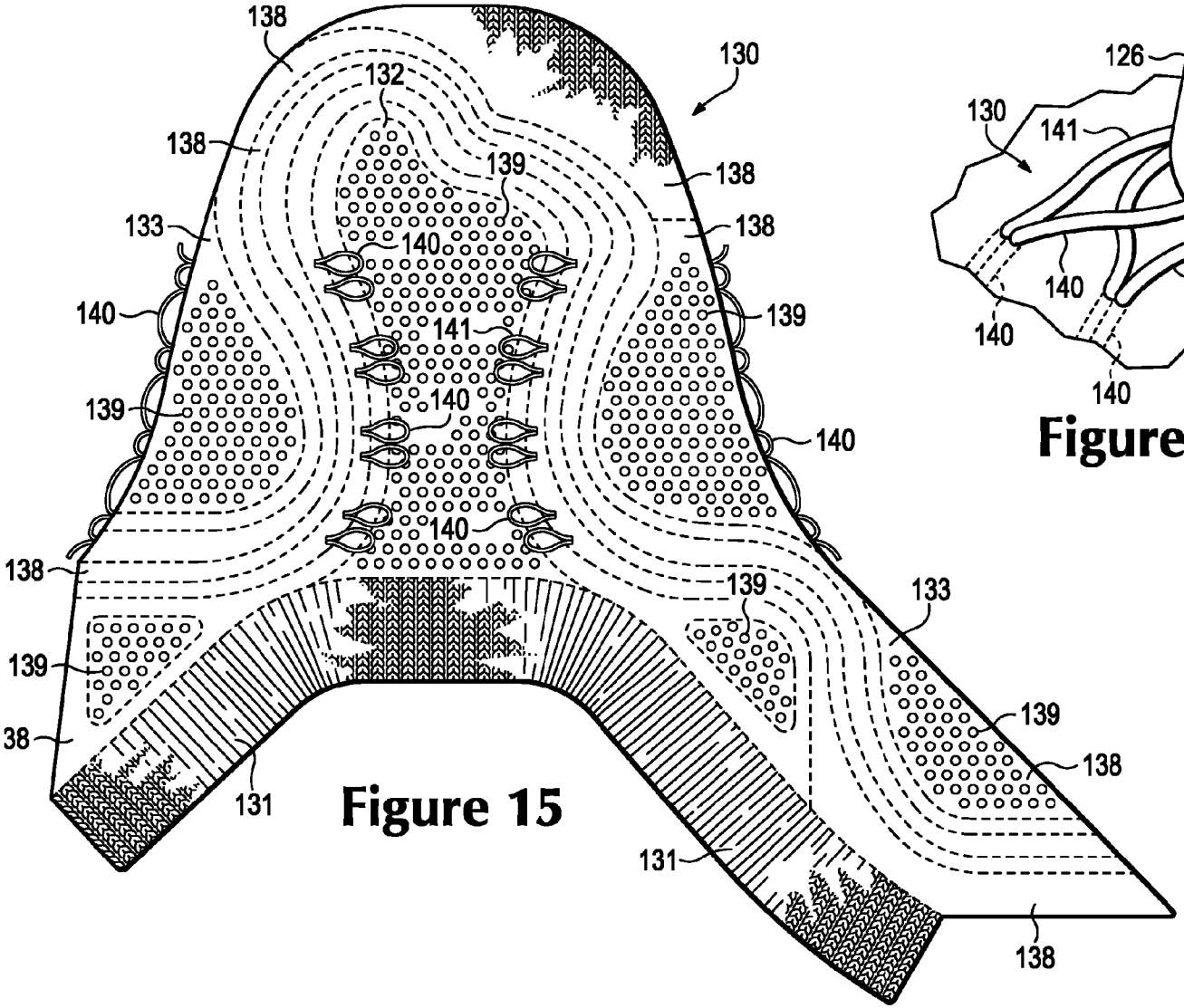
FIG. 15 is a top plan view of another knitted component configuration that may be utilized with the article of footwear.

Another configuration of knitted component 130 is depicted in FIG. 15 as including (a) multiple subregions 138 within peripheral region 133 and (b) a plurality of apertures 139 that extend through knitted component 130 in areas of central region 132 and peripheral region 133. Subregions 138 may be areas where knitted component 130 has different types and combinations of stitches and yarns. Each of subregions 138 may, therefore, have different properties, such as stretch-resistance, thickness, air permeability, and abrasion-resistance. Alternately, subregions 138 may vary only in the color of yarn that is utilized, thereby varying the aesthetics of upper 120. In addition to increasing the air permeability of upper 120, apertures 139 may also impart the ability to stretch to knitted component 130. That is, apertures 139 may decrease the stretch-resistance of knitted component 130 in specific areas. Accordingly, various features and structures within knitted component 130 may vary considerably to provide specific properties to areas of knitted component 130.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An upper for securing to a sole structure to form an article of footwear, the upper comprising a knitted component and a strand having a first section disposed within the knitted component, a second section located exterior of the knitted component and forming a lace loop that is configured to receive a lace, and a third section disposed within the knitted component, the first section and the third section being positioned immediately adjacent to each other between opposite, substantially parallel surfaces of the knitted component that define a single layer of the knitted component, wherein the strand forms a plurality of lace loops, and a pair of the lace loops positioned immediately adjacent to each other overlap each other so as to form a common aperture that is configured to receive a single pass of the lace, and wherein the pair of the lace loops overlap each other in a direction substantially normal to an outer surface portion of the knitted component that is immediately adjacent to the common aperture.

2. The upper recited in claim 1, wherein the first section and the third section are located within two millimeters of each other.

3. The upper recited in claim 1, wherein the first section and the second section extend between a throat area and a lower area of the upper.

4. The upper recited in claim 1, wherein the strand forms a plurality of additional lace loops located on opposite sides of the upper.

5. The upper recited in claim 1, wherein the strand has a greater stretch-resistance than the knitted component.

6. The upper recited in claim 1, wherein the knitted component includes a thermoplastic polymer material, and the strand is unbonded with the thermoplastic polymer material.

7. The upper recited in claim 1, wherein the knitted component has (a) a collar region that forms a collar, (b) a central region that extends outward from the collar region, and (c) a peripheral region that extends at least partially around the central region; the collar region, the central region, and the peripheral region being formed of unitary knit construction, and the first section and the third section of the strand being disposed within the peripheral region.

8. The upper recited in claim 7, wherein a yarn in the peripheral region includes a thermoplastic polymer material, and the thermoplastic polymer material is substantially absent from the collar region and the central region.

9. The upper recited in claim 1, wherein the knitted component is a flat knitted component.

10. An upper for securing to a sole structure to form an article of footwear, the upper comprising a knitted component and a strand that is disposed within the knitted component between opposite, substantially parallel surfaces of the knitted component that define a single layer of the knitted component, portions of the strand being located exterior of the knitted component and forming a plurality of loops, pairs of the loops being positioned immediately adjacent to each other configured to receive a lace, and wherein a pair of the lace loops positioned immediately adjacent to each other overlap each other so as to form a common aperture that is configured to receive a single pass of the lace, and wherein the pair of the lace loops overlap each other in a direction substantially normal to an outer surface portion of the knitted component that is immediately adjacent to the common aperture.

11. The upper recited in claim 10, wherein the strand has a greater stretch-resistance than the knitted component.

12. The upper recited in claim 10, wherein the knitted component includes a thermoplastic polymer material, and the strand is unbonded with the thermoplastic polymer material.

13. The upper recited in claim 10, wherein the knitted component has (a) a collar region that forms a collar, (b) a central region that extends outward from the collar region, and (c) a peripheral region that extends at least partially around the central region; the collar region, the central region, and the peripheral region being formed of unitary knit construction.

14. The upper recited in claim 13, wherein a yarn in the peripheral region includes a thermoplastic polymer material, and the thermoplastic polymer material is substantially absent from the collar region and the central region.

15. The upper recited in claim 13, wherein the collar region is formed as a half-gauge knit, and the central region and the peripheral region are formed as a full gauge knit.

16. The upper recited in claim 10, wherein the knitted component is a flat knitted component.

* * * * *